US007164993B2

(12) United States Patent
Likness et al.

(10) Patent No.: US 7,164,993 B2
(45) **Date of Patent: *Jan. 16, 2007**

(54) METHOD FOR MEASURING SMOKING TOPOGRAPHY

(75) Inventors: Mark A. Likness, Baltimore, MD (US); Robert M. Wessel, Millersville, MD (US)

(73) Assignee: Plowshare Technologies, Inc., Baltimore, MD (US)

( * ) Notice: Subject to any disclaimer, the term of this patent is extended or adjusted under 35 U.S.C. 154(b) by 1 day.

This patent is subject to a terminal disclaimer.

(21) Appl. No.: 10/214,330

(22) Filed: Aug. 8, 2002

(65) Prior Publication Data

US 2004/0030508 A1 Feb. 12, 2004

(51) Int. Cl.
*G01F 1/00* (2006.01)
*G01F 7/00* (2006.01)

(52) U.S. Cl. ..... 702/45

(58) Field of Classification Search ..... 702/45–47, 702/98, 138, 176, 182, 183; 131/175, 187, 131/330, 331

See application file for complete search history.

(56) References Cited

U.S. PATENT DOCUMENTS

2004/0031497 A1* 2/2004 Likness et al. ..... 131/270

OTHER PUBLICATIONS

Plowshare Technologies, "Clinical Research Support System CReS-Simicro/CReSShost User Guide", Rev. 0.0, Published Mar. 28, 2002.*

Wayne Kashinsky et al., "A Telemetric Device for Measuring Smoking Topography," Behavior Research Methods, Instruments and Computers 1995, 27(3), pp. 375-378.

David Satcher, MD, PhD, U.S. Surgeon General, "A Call for Action: Surgeon General's Report," Center for Disease Control (CDC), Reducing Tobacco Use, Apr. 10, 2002, pp. 1-4.

Message from Donna E. Shalala, Secretary of Health and Human Services; Jeffrey P. Koplan, M.D., Director for CDC, and David Satcher, MD, PhD, U.S. Surgeon General, "Reducing Tobacco Use: A Report of the Surgeon General—Executive Summary," Atlanta, Georgia (Preface i-iii and pp. 1-22) 2000.

Preliminary Product Information, "Portable Smoking Topography Measurement Device," (Revisions from Jan./Feb. 2000 and Feb./Mar./Oct. 2001) Plowshare Technologies, Inc., Feb. 5, 2002, pp. 4-8.

(Continued)

*Primary Examiner*—Michael Nghiem
(74) *Attorney, Agent, or Firm*—Venable LLP; Ralph P. Albrecht

(57) ABSTRACT

A method for measuring topographical information to provide smoking topographical information including providing a portable smoking topography measurement unit having a smoking material holder; inserting a smoking material into the smoking material holder of the portable smoking topography measurement unit; detecting each puff of the smoking material; measuring flow rate of smoking from a smoking material into a subject during each puff; computing puff information; eliminating false puffs from the puff information; computing smoking material information; and storing puff information and smoking material information in a memory. The puff information and smoking material information is transferred from the memory of the portable smoking topography measurement unit to a workstation, and the puff information and smoking material information is displayed on a display unit.

30 Claims, 11 Drawing Sheets

OTHER PUBLICATIONS

P. Puustinen, et al., "Microcomputer Assisted Measurement of Inhalation Parameters During Smoking," Toxic Interferences of Neurones, Smoke and Genes, Arch. Toxicol., Suppl. 9, 111-114 (1986).

Pekka Puustinen et al., "Microcomputer-Aided Measurement of Puff Parameters During Smoking of Low—and Medium-Tar Cigarettes," Scand. J. Clin. Lab Invest. 1987; 47:665-600.

Plowshare Technologies, "Clinical Research Support System CReSSmicro/CReSShost User Guide", Revision 0.3, Feb. 12, 2003, pp. 1-46.

Plowshare Technologies, "Clinical Research Support System CReSSmicro/CReSShost User Guide", Revision 0.2, Jan. 27, 2003, pp. 1-45.

Plowshare Technologies, "Clinical Research Support System CReSSmicro/CReSShost User Guide", Revision 0.1, Aug. 10, 2002, pp. 1-25.

Plowshare Technologies, New Product Information, CReSSmicro, "Portable Smoking Topography Measurement Device," Rev 5, Feb. 11, 2002.

* cited by examiner

METHOD FOR MEASURING SMOKING TOPOGRAPHY

The U.S. Government may have a paid-up license in this invention and the right in limited circumstances to require the patent owner to license others on reasonable terms as provided for by the terms of Grant No. 1R43DA13882-01 awarded by the National Institute on Drug Abuse.

BACKGROUND OF THE INVENTION

1. Field of the Invention

The present invention relates to a method for measuring smoking topography.

2. Description of the Related Art

Tobacco use, particularly cigarette smoking, is the leading cause of preventable illness and death in the United States. Despite the availability of pharmacotherapies for tobacco dependence, each year more than 400,000 Americans die too young because of smoking-related diseases. Nearly, one in four U.S. Adults and one in three teenagers smoke. Tragically, if current trends continue, an estimated 25 million people (including 5 million of today's children) will die prematurely of smoking-related disease. Cigarette smoking costs an estimated 419,000 American lives and $100 billion in direct and indirect health care expenses annually (Center for Disease Control 1994).

As indicated in the Surgeon General's Report titled "Reducing Tobacco Use" published in the year 2000, tobacco dependence is currently viewed as a chronic disease with remission and relapse. Although interventions do provide some cessation from smoking, achieving long-term abstinence from smoking has been extremely difficult for smokers. There is little understanding of how various treatments produce therapeutic effects. Since the overall success in improving the public health depends upon a dramatic reduction in the rate of tobacco use, clinical researchers require state-of-the-art tools that will help identify factors that change smoking behavior. Tools that provide detailed measurements of smokers' puffing behavior have long been a mainstay in successful smoking research programs, and they continue to help clinical researchers understand the factors that influence tobacco use in the laboratory. Smoking topography or puff topography refers to the measures that assess puffing behavior.

Measurement of smoking topography variables such as puff volume, puff duration, inter-puff interval, peak flow, and the number of puffs by a smoker has been central to the study of smoking behavior. Smoking topography measurement has demonstrated that nicotine self-administration helps to drive tobacco use, and has predicted in the laboratory, the efficacy of nicotine replacement medications. Additionally, the sensitivity gained by puff topography measurement has uncovered factors that change cigarette use, including personality type, gender, time of day, and smoke dilution through filter ventilation holes. Smoking topography may be critical in the assessment of nicotine dependence in smokers. Thus, the ability to measure smoking topography is likely essential to comprehensive research programs tasked to understand and treat smoking behavior.

In the prior art, smoking topography measurement devices used a cigarette holder or mouthpiece that acts as a flowmeter to capture pressure differences as smoke is inhaled through the holder. A pressure sensor converts pressure to voltage, which is then converted to flow rate using calibrated computer software. While highly effective in a laboratory setting, these smoking topography devices share the disadvantage of relying on locally made hardware and software. Therefore, Plowshare® Technologies, Inc. developed the Clinical Research Support System (CReSS). This desktop system, based on well-tested measurement techniques, used an integrated Windows® platform that automates data collection in smoking topography. The primary components of the CReSS are a personal computer 1 running a Windows® operating system, a mouthpiece 3 holding a cigarette, and a measurement interface unit 2 connected to the personal computer 1 and mouthpiece 3 as shown in FIG. 1. CReSS assesses puffing behavior using a differential pressure flow meter contained in a plastic mouthpiece 1 tethered by vinyl tubing to a measurement interface unit 2. By measuring differential pressure at the two precisely placed taps in the mouthpiece 3, CReSS accurately calculates flow rate during each smoking inhalation. The relationship between differential pressure and flow rate is given by a power equation based on the respective diameters of the flow meter components and location of the pressure taps. When precise timing is correlated with instantaneous measured flow, smoking topographical information can be derived including: puff volume, puff duration, puff number, inter-puff interval (time between the end of one puff and the beginning of the next puff), and peak puff flow rate (highest sampled flow rate).

Although CReSS as a desktop or laptop measurement system provides smoking topographical information in a clinical laboratory setting, CReSS can not be used for smoking topography measurements outside of the intended clinical laboratory setting. It is simply impractical for a smoker to carry a personal computer 1, measurement interface unit 2, and a tethered mouthpiece 3 for ambulatory measurement during a smoker's daily routine. Therefore, CReSS is impractical for natural smoking topography measurements while a smoker is in his or her normal everyday environment.

Naturalistic observation of a smoker is very important in smoking research because the smoker's environment may influence smoking behavior. Some factors that modulate or change smoking behavior are environment-specific. These factors include the proximity of other smokers, the influence of smoking and non-smoking peers, and the availability of other reinforcing activities that are incompatible with smoking, such as physical activity. The relative influence of these factors may be studied most optimally in the natural environment, provided that adequate smoking topography measurement equipment is available. Studying cigarette behavior in the natural environment will be essential to understanding the etiology of tobacco dependence—why people alter their tobacco use patterns from first use, to occasional use, to eventual regular, daily use. Therefore, there is a need for providing a truly portable smoking topography measurement device or system capable of accurately measuring smoking topography wherever a smoker chooses to smoke. Moreover, there is a similar need for a smoking topography measurement device capable of measuring any substance, which can be inhaled through the mouth including other drugs such as marijuana.

BRIEF SUMMARY OF THE INVENTION

In one embodiment, the present invention relates to a method for providing smoking topographical information, comprising: providing a portable smoking topography measurement unit having a smoking material holder; inserting a smoking material into the smoking material holder of the portable smoking topography measurement unit; detecting each puff of the smoking material; measuring flow rate of smoke from a smoking material into a subject during each puff; computing puff information; eliminating false puffs from the puff information; and storing puff information in a memory.

The step of detecting each puff comprises sensing each puff; reading time each puff is sensed from a real time clock to provide a puff start time; storing each puff start time; detecting end of each puff; reading time each puff ended from the real time clock to provide puff end time; and storing each puff end time. The step of measuring flow rate of smoke comprises sampling the flow rate of smoke using a pressure sensor; storing each sampled flow rate of smoke in memory; and incrementing a sample counter each time the smoking topography measurement unit samples the flow of smoke to provide a puff sample count. The computing puff information step comprises computing average flow rate for each puff by dividing the sum of the flow rates by the puff sample count. The computing puff information step comprises computing puff volume.

The computing puff information comprises computing a peak flow rate for each puff based on highest flow rate sampled during each puff. The method step further comprises reading the time when each flow rate sample was taken from the real time clock; and storing the time each flow rate sample was taken in memory. The method step of computing puff information comprises computing time of peak flow rate for each puff. The computing puff information step comprises computing puff duration for each puff based on difference between puff start time and puff end time. The computing puff information step comprises computing each inter-puff interval based on difference between puff start time of one puff and puff end time of immediately preceding puff.

The method further comprises computing smoking material information, where the step of computing smoking material information comprises detecting insertion of smoking material into smoking material holder; reading time of insertion of smoking material from the real time clock to provide smoking material insertion time; storing smoking material insertion time in memory; incrementing a puff counter each time a puff is detected; detecting removal of the smoking material from the smoking material holder; reading time of removal from the real time clock to provide smoking material removal time; and storing smoking material removal time in memory. The method step of computing smoking material information further comprises reading the value of the puff counter after the smoking material is removed to provide the number of puffs per smoking material. The method step of computing smoking material information comprises calculating the total smoking material time by determining the difference between the smoking material insertion time and the smoking material removal time.

The method step of computing smoking material information comprises calculating time to first puff by determining the difference between smoking material insertion time and puff start time of first puff of smoking material. The method step of computing smoking material information comprises calculating time interval from last puff to smoking material removal by determining the difference between smoking material removal time and end time of last puff of smoking material. The method step further comprises transferring at least one of the puff information and smoking material information stored in memory to a workstation. The method further comprises transferring puff information stored in memory to a workstation. The method further comprises displaying at least one of puff information and smoking material information on a display unit.

In another embodiment, the present invention relates to a method for providing smoking topographical information, comprising: providing a portable smoking topography measurement unit having a smoking material holder containing a smoking material; detecting each puff of the smoking material; computing puff information; eliminating false puffs from the puff information; and storing puff information in a memory. The method further comprising incrementing a puff counter each time a puff is detected. The step of eliminating false puffs comprises decrementing a smoking material puff counter by one each time a false puff is detected. The method further comprises: determining the start time and end time of each puff;, and determining puff duration of each puff based on the difference between the start time and end time of each puff. The method step of eliminating false puffs from the puff information further comprises: identifying puff as a false puff if the puff duration is less than a predetermined minimum; and eliminating false puffs from the puff information. The method step of eliminating false puffs from the puff information further comprises calculating time bias to be applied to the inter-puff interval of the puff following the false puff to account for the false puff's inter-puff interval and duration.

The method further comprises measuring flow rate of smoke by sampling the flow rate of smoke from the smoking material into a subject during each puff; storing each sampled flow rate of smoke in memory; incrementing a counter each time the smoking topography measurement unit samples the flow of smoke to provide a puff sample count; and determining average flow rate by summing measured flow rates and dividing the measured flow rates by the sample count. The method further comprises reading the time when each flow rate sample was taken from a real time clock. The method step of computing puff information comprises determining the start time and end time of each puff; determining puff duration of each puff based on the difference between start time and end time of each puff; and computing puff volume. The method step of eliminating false puffs from the puff information further comprises: identifying puff as a false puff if the puff volume is less than a predetermined minimum; and eliminating false puffs from the puff information. The method step of eliminating false puffs further comprises calculating time bias to be applied to the inter-puff interval of the puff following the false puff to account for the false puff's inter-puff interval and duration.

The method step of detecting each puff of the smoking material, comprises: sensing each puff; reading time each puff is sensed from a real time clock to provide a puff start time; storing each puff start time; detecting end of each puff; reading time each puff ended from the real time clock to provide puff end time; and storing each puff end time. The method step of computing puff information further comprises: measuring flow rate of smoke by sampling the flow rate of smoke from the smoking material into a subject during each puff; storing each sampled flow rate of smoke in memory; incrementing a sample counter each time the smoking topography measurement unit samples the flow of smoke during each puff to provide a sample count for each puff; determining average flow rate of each puff by summing measured flow rates during each puff and dividing the measured flow rates during each puff by the sample count of each puff; computing puff duration for each puff based on the puff start time and puff end time; computing puff volume for each puff; computing peak flow rate for each puff based on highest flow rate sampled during each puff; and computing peak flow time based on time of highest flow rate.

The method step of eliminating false puffs from the puff information further comprises: determining the inter-puff interval between puffs; comparing the inter-puff interval of each puff to a predetermined minimum allowed puff; identifying each puff having an inter-puff interval, which is less than a predetermined minimum puff as a false puff; and eliminating false puffs from the puff information. The method step of eliminating false puffs from the puff information further comprises computing new puff duration based on false puff duration and duration of immediately preceding puff. The method step of eliminating false puffs from the puff information further comprises computing new puff volume based on false puff volume and immediately preceding puff volume. The method step of eliminating false puffs from the puff information further comprises comparing peak flow rate for the false puff and the peak flow rate of immediately preceding puff, and selecting highest peak flow rate as the peak flow rate. The method step of eliminating false puffs from the puff information includes computing time of peak flow rate based on the time of the selected peak flow rate. The method step of eliminating false puffs from the puff information further comprises calculating average flow rate based on the average flow rate of the false puff and the average flow rate of the immediately preceding puff.

In another embodiment, the method for providing smoking topographical information, comprises providing a portable smoking topography measurement unit having a smoking material holder containing a smoking material; detecting each puff of the smoking material; computing puff information; storing puff information in a memory; interfacing the portable smoking topography measurement unit with the workstation; transferring puff information from the memory to the workstation; and displaying the puff information on a display unit. The method further comprises the step of authenticating puff information before puff information is transferred from the memory to the workstation. The method further comprises eliminating false puffs from the puff information. The method further comprises computing smoking material information, and storing smoking material information in the memory. The method further comprising authenticating puff information and smoking material information before the puff information and smoking material information is transferred from the memory to the workstation.

DETAILED DESCRIPTION OF THE INVENTION

Exemplary embodiments of the invention are discussed in detail below. While specific exemplary embodiments are discussed, it should be understood that this is done for illustration purposes only. A person skilled in the relevant art will recognize that other components and configurations can be used without parting from the spirit and scope of the invention. The embodiments and examples discussed herein are non-limiting examples.

Figure 1:
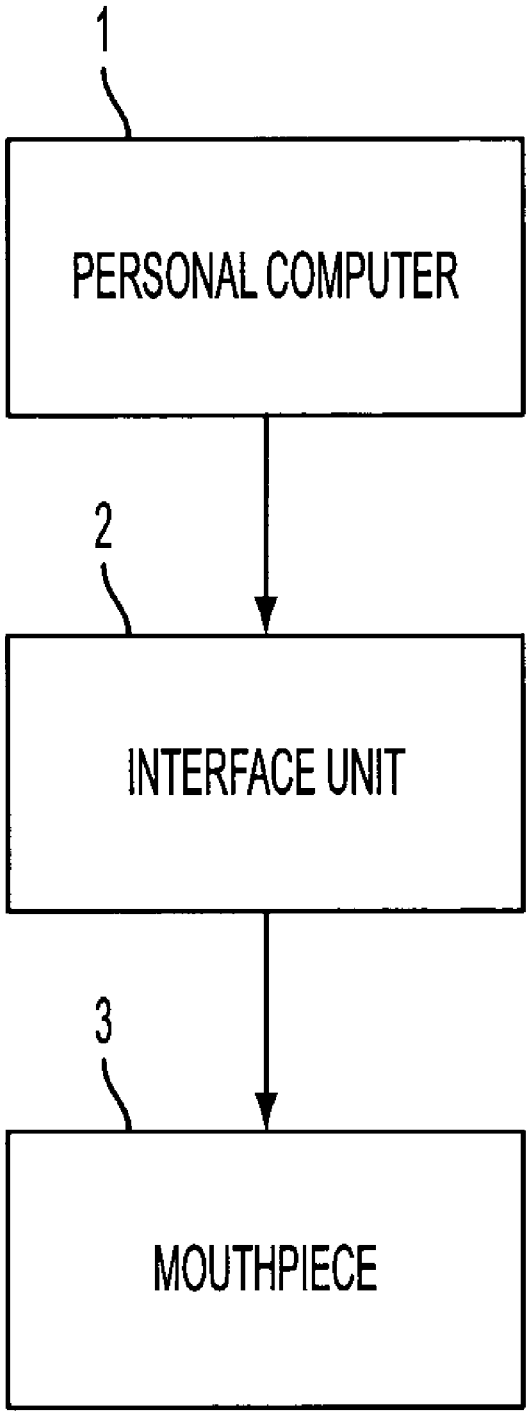
FIG. 1 (PRIOR ART)
FIG. 1 is a block diagram of a prior art smoking topography measurement device.
Figure 2:
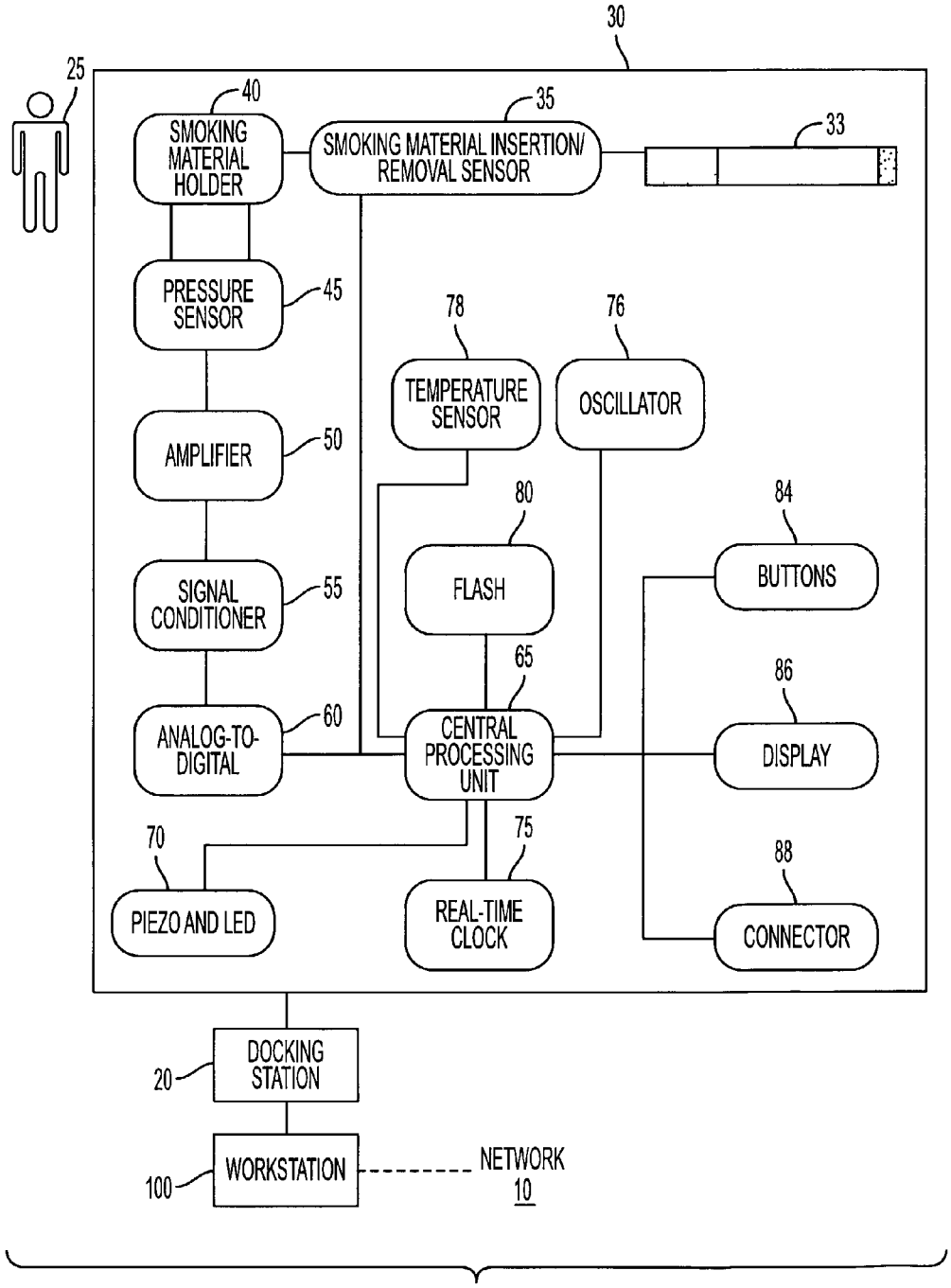
FIG. 2 is a block diagram of a portable smoking topography measurement system in accordance with an embodiment of the present invention.

FIG. 2 is a block diagram of a portable smoking topography measurement system in accordance with an embodiment of the present invention. FIG. 2 shows a stand-alone workstation 100, which may be communicating with a network 10. The workstation 100 is preferably coupled to a docking station 20 adapted to receive a portable smoking topography measurement unit 30. The docking station 20 permits the workstation 100 to download smoking topography data from the portable smoking topography measurement unit 30. The docking station 20 also permits the workstation to configure the portable smoking topography measurement unit 30 for use in a clinical study and charge a battery (not shown). The smoking topography information (smoking topography data) may include actual samples or measurements taken by the smoking topography measurement unit 30 as well as information derived from the actual samples or measurements using a computer software program contained in the smoking topography measurement unit 30.

A subject 25 (person) carries the portable smoking topography measurement unit 30. When the subject 25 wishes to smoke, the subject 25 places a smoking material 33 into the smoking material holder 40 of the smoking topography measurement unit 30. The smoking material 33 may be a tobacco product such as a cigar or cigarette. Alternatively, the smoking material 33 may include another drug such as marijuana. The smoking material 33 is intended to comprise any substance, which can be inhaled through the mouth by a subject. A smoking material insertion/removal sensor 35, mounted to the smoking material holder 40, senses the presence or absence of a smoking material 33. The smoking topography measurement unit 30 includes a pressure sensor 45 sensing the pressure caused by the subject 25 puffing a smoking material 33. There is a mathematical relationship between the sensed pressure and the flow rate of smoke into the subject 25. The flow rate is directly proportional to the square root of the pressure differential created by the flow within the smoking material holder 40. The general equation is $Y=mX^{1/2}$, where Y is the flow rate term. The constant m is an empirically-derived constant based on the respective diameters of the flow meter components, the location of the pressure taps, and the discharge coefficient of the flow meter. The term X represents the differential pressure, which is the analog signal emitted by the pressure sensor 45. The pressure sensor 45 outputs an analog signal to an amplifier 50, which amplifies the analog signal. A signal conditioner 55 receives an amplified analog signal from the amplifier 50, and transmits the conditioned (filtered) signal to the analog to digital converter 60, which converts the analog signal to digital data representing the sensed pressure caused by the subject 25 puffing a smoking material 33. A central processing unit 65 (microprocessor, processor, or other computing device) receives and processes the digital data to provide the flow rate (Y) of smoke into the subject 25. The central processing unit 65 stores the digital data in a flash memory 80. The flash memory 80 also stores the software program for operating the smoking topography measurement unit 30 including making smoking topography measurements (smoking topography data collection), and for deriving smoking topography information. Alternatively, the central processing unit 65 may have an internal flash, which may store the software program for operating the smoking topography measurement unit 30. A piezo buzzer for audible confirmations and an LED for visible indications of device status or other information 70 are connected to the central processing unit 65. (The piezo and LED 70 are optional). A real time clock 75 supplies a running time and date to the central processing unit 65. An oscillator 76 supplies a clock signal to the central processing unit 65. A temperature sensor 78 supplies an operating temperature to the central processing unit 65. The smoking topography measurement device 30 may also include buttons 84 for user interaction, a display (e.g. liquid crystal display) 86 for displaying status and other information, and a connector 88 for connecting the portable smoking topography measurement unit 30 to the docking station 20. (The buttons 84 and display 86 are optional). Although connecting the portable smoking topography measurement unit 30 to the workstation 100 by docking station 20 is preferable, the portable smoking topography measurement unit 30 may be connected directly to the workstation 100 by a cable.

Figure 3:
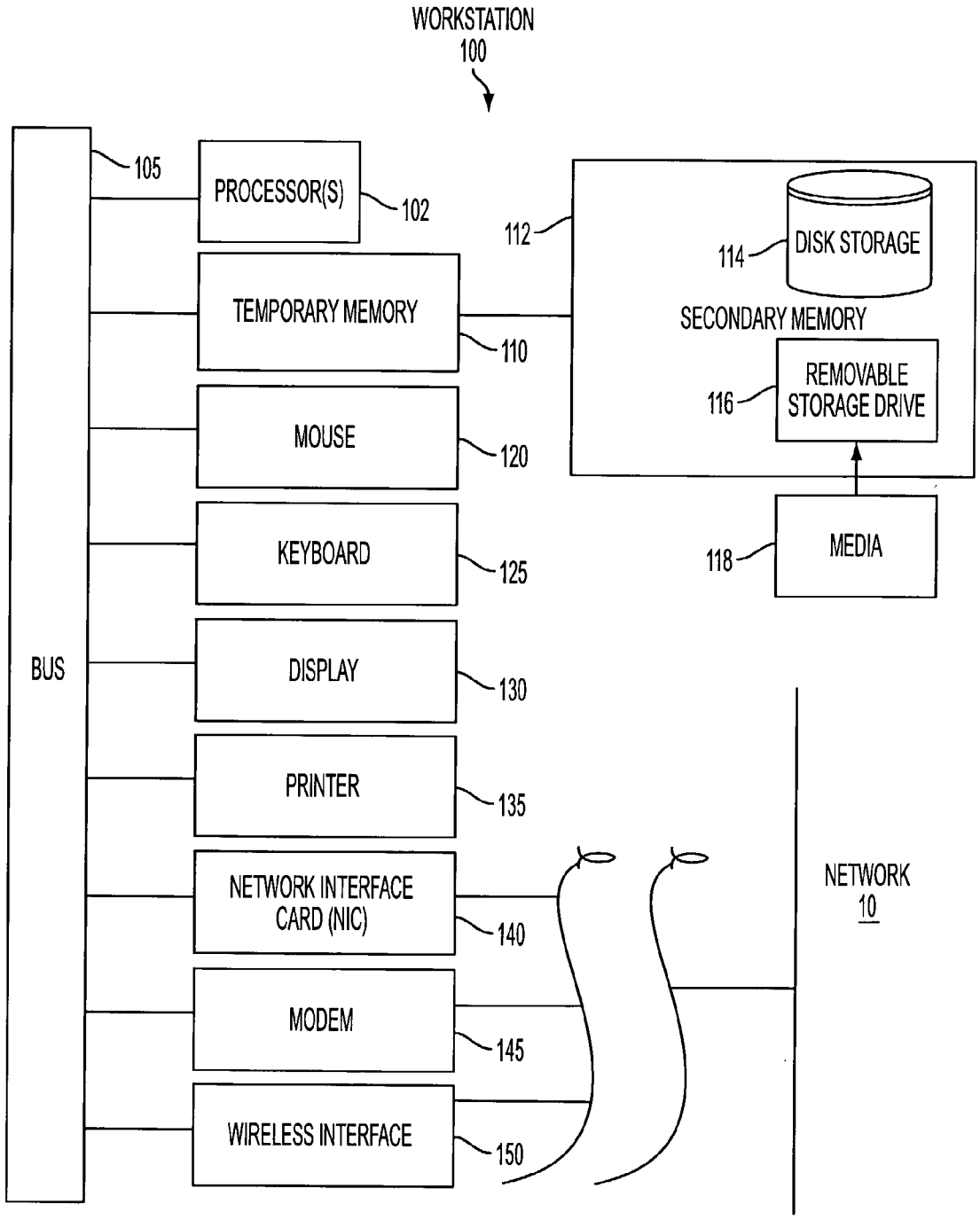
FIG. 3 is a block diagram of a workstation.

FIG. 3 shows a block diagram of a workstation 100 coupled to the network 10, which provides an example of hardware which may be used in implementing certain aspects of the invention. Workstation 100 preferably includes one or more processors 102 coupled to a bus 105. The bus 105 can be coupled to any of various subsystems including: a temporary memory 110; a secondary memory 112 such as, a disk 114, and/or a removable storage drive 116 into which media 118 can be placed including, e.g., a diskette, a compact diskette (e.g. CD ROM) or the like; an input device such as a mouse 120, or a keyboard 125; an output device such as a display 130 or printer 135; and input/output (I/O) devices to a network 10 such as network interface card (NIC) 140 such as an Ethernet, Token Ring, Smart and Asynchronous Transfer Mode (ATM) cards. Other input/output devices may include a modem 145, or other input/output device such as, a wireless interface 150 (e.g. a wireless transceiver). It will be apparent to those skilled in the relevant art that the above-described workstation 100 has been provided as an example and is not intended to limit the breadth of the invention in any way. The software accessing data from the portable smoking topography measuring unit 30 may be stored on any storage medium, which can be accessed by the workstation 100.

Figure 4:
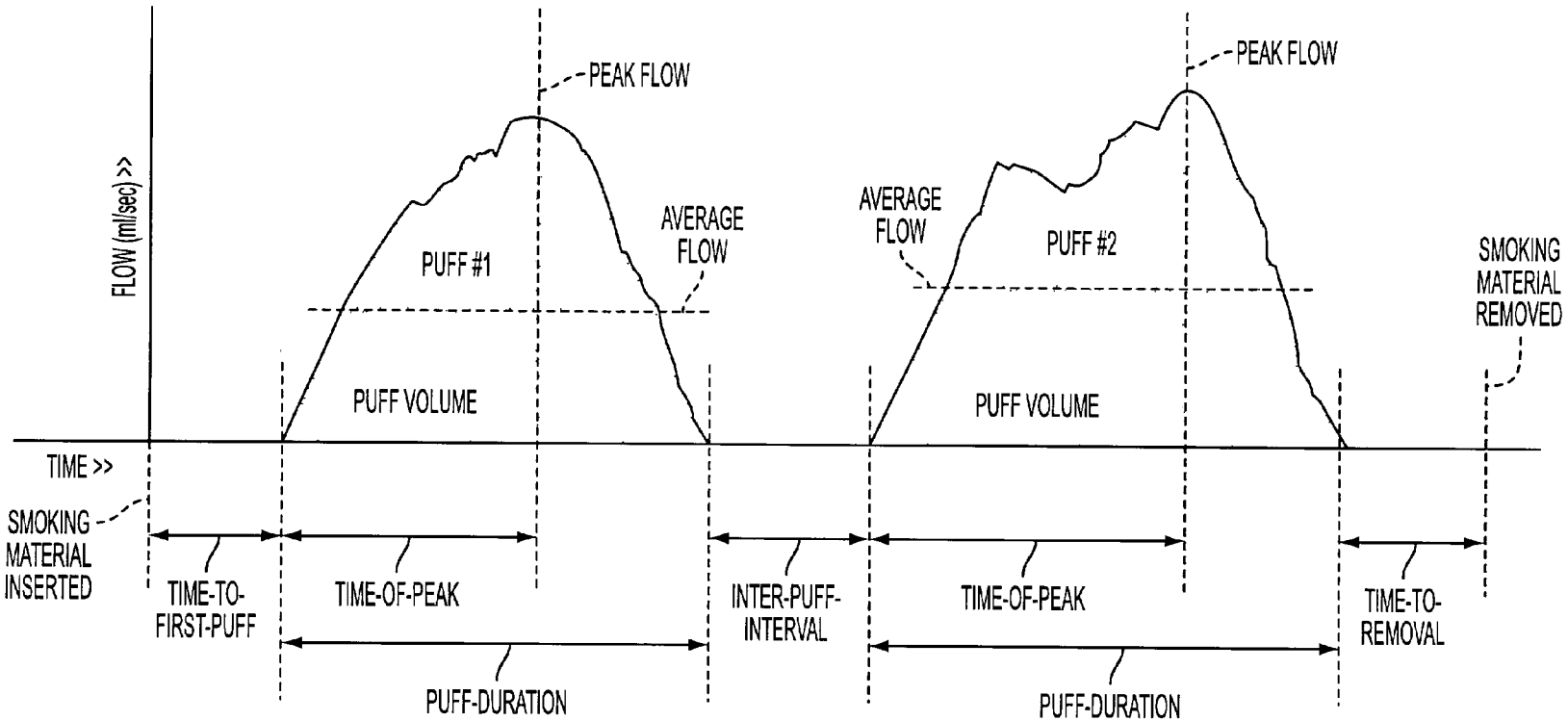
FIG. 4 is a diagram showing an example of puff information.

The portable smoking topography measuring unit 30 measures, analyzes, and computes a large number of smoking characteristics or smoking topographical information including: puff volume, puff duration, inter-puff interval, peak puff flow rate during puff, time of peak puff flow rate, mean flow during puff, puffs per smoking material, total smoking material time, time to first puff of smoking material, time to removal of smoking material, total smoking material volume, smoking materials per hour, smoking materials per day, smoking materials per week, smoking materials per month, date and time of the start and end of each smoking material smoked, and environmental temperature. These smoking characteristics are collectively known as "smoking topography." Further, these smoking characteristics may be divided into three categories: puff information, smoking material information, and environment. The puff information category includes at least one of the following: puff volume, puff duration, inter-puff interval, peak puff flow rate, time of peak puff flow rate, and mean (average) puff flow rate. (See example shown in FIG. 4). The smoking material information category includes at least one of the following: puffs per smoking material, total smoking material time, time to first puff of smoking material, time to removal of smoking material, total smoking material volume, smoking materials per hour, smoking materials per day, smoking materials per week, smoking materials per month, and date and time each smoking material smoked. The environment category includes environmental temperature.

Puff volume is the amount of smoke drawn by the subject 25 in one puff.

Puff duration is time between the start and end of a puff by a subject 25.

Inter-puff interval (IPI) is the length of time between the start of one puff and the end of the immediately preceding puff of the smoking material 33 by the subject 25.

Peak puff flow rate is the highest flow rate of smoke into the subject 25 during a puff.

Time of peak puff flow rate is the point in time when the highest flow rate of smoke into the subject 25 during a puff is recorded.

Mean puff flow rate is the average flow rate of smoke into the subject 25 during a puff.

Puffs per smoking material 33 is the number of draws of smoke by the subject 25 of one smoking material 33.

Total smoking material time is the amount of time a subject 25 has a smoking material 33 in the smoking material holder 40.

Time to first puff of smoking material 33 is the amount of time between the insertion of the smoking material 33 into the smoking material holder 40 and the start of the first puff by the subject 25.

Time to removal of smoking material 33 is the amount of time between the end of the last puff of the smoking material 33 and the removal of smoking material 33 from the smoking material holder 40.

Total smoking material volume is the total amount of smoke drawn by the subject 25 for one smoking material.

Smoking materials per hour is the number of smoking materials 33 inserted and removed from the smoking material holder 40 per hour.

Smoking materials per day is the number of smoking materials 33 inserted and removed from the smoking material holder 40 per day.

Smoking materials per week is the number of smoking materials 33 inserted and removed from the smoking material holder 40 per week.

Smoking materials per month number of smoking materials 33 inserted and removed from the smoking material holder 40 per month.

Date and time each smoking material smoked is the date and time at which each smoking material 33 is inserted into the smoking material holder 40 and the date and time at which the smoking material 33 is removed from the smoking material holder 40.

Environmental temperature is the temperature within the portable smoking topography measurement unit as detected by the temperature sensor 78. The temperature is recorded when the smoking material 33 is first detected by the smoking material insertion/removal sensor 35. It may be used for tracking the use of the device under different environmental conditions.

FIGS. 5–9 are flowcharts showing one embodiment of the present invention. While the smoking material holder 40 of the portable smoking topography measurement unit 30 does not have a smoking material 33, the portable smoking topography measurement unit 30 is preferably in the idle mode (step 200) to conserve battery power. Once the smoking material insertion/removal sensor 35 mounted to the smoking material holder 40 recognizes that a smoking material 33 has been placed in the smoking material holder 40 (step 210), the strength of the battery is preferably checked (step 220). However, the strength of the battery may be checked routinely regardless of whether insertion of a smoking material 33 has been detected by insertion/removal sensor 35. If the battery is not charged, then the portable smoking topography measurement unit 30 remains in idle (step 200).

If the battery has sufficient power and the smoking material insertion/removal sensor 35 senses a smoking material 33 in the smoking material holder 40, the central processing unit 65 preferably reads the real-time and date from the real-time clock 75, and preferably reads the temperature from the temperature sensor 78 after the central processing unit 65 receives an analog signal from the smoking material insertion/removal sensor 35 (step 230). However, the temperature could be read at any time before the puff information is calculated. The time, date, and temperature are preferably stored in the flash memory 80 (step 240), and the smoking material timer is started (step 250). The pressure sensor 45, amplifier 50, signal conditioner (filter) 55, and analog-to-digital converter 60 are enabled so that the central processing unit 65 can receive digital data representing flow measurements (step 270).

The pressure sensor 45 preferably detects when a subject 25 starts to puff a smoking material 33 (step 275). If the pressure sensor 45 does not detect a puff after a first predetermined time, the central processing unit 65 checks whether the smoking material 33 has been removed from the smoking material holder 40 or a second predetermined time has passed (step 280). The first and second predetermined time may be the same or different. If the smoking material 33 is still inserted in the smoking material holder 40 and a second predetermined time has not passed, then the pressure sensor 45 and central processing unit 65 continue to wait for an indication of a puff from the pressure sensor 45 (step 270). However, if the central processing unit 65 receives a signal from the smoking material insertion/removal sensor 35 indicating that the subject 25 has removed the smoking material 33 or the second predetermined time has elapsed (step 280), the battery is preferably checked (step 285). If the battery has sufficient power, the smoking material information is calculated (step 286) by using the measured (collected) digital data. Then, the smoking material information is stored in the flash 80, and a sound is preferably emitted (e.g. beeps) (step 290). Subsequently, flow measurement is disabled by disabling the pressure sensor 45, the amplifier 50, the signal conditioner 55, and the analog-to-digital converter 60. The central processing unit 65 reads the time and date from the real time clock 65, and the central processing unit 65 stores the time and date in the flash 80. Further, the smoking material timer is stopped (step 295). The smoking topography measuring unit 30 remains in idle (step 200) until the smoking material insertion/removal sensor 35 senses a smoking material 33 placed in the smoking material holder 40 (step 205).

If the battery does not have sufficient power (step 285), then the flow measurement is disabled by disabling the pressure sensor 45, the amplifier 50, the signal conditioner 55, and the analog-to-digital converter 60. Further, the central processing unit 65 preferably reads the time and date from the real time clock 75, and the central processing unit 65 stores the time and date in the flash 80. Further, the smoking material timer is stopped (step 295). The smoking topography measuring unit 30 remains in idle (step 200) until the smoking material insertion/removal sensor 35 senses a smoking material 33 placed in the smoking material holder 40 (step 205), and the battery has sufficient power (step 210).

As discussed above, the pressure sensor 45 preferably detects when a subject 25 starts to puff a smoking material 33 (step 275). If the pressure sensor 45 detects a subject 25 starting a puff, the flow samples are collected (step 300). If the puff has not ended (step 305), then the central processing unit 65 checks whether the smoking material 33 has been removed from the smoking material holder 40 or a predetermined time has passed (step 306). If the smoking material 33 is still inserted in the smoking material holder 40 and the predetermined time has not passed, then the pressure sensor 45 and central processing unit 65 continue to collect flow samples (step 300). Each time a sample is taken (collected), a sample counter is incremented. However, if the central processing unit 65 receives a signal from the smoking material insertion/removal sensor 35 indicating that the subject 25 has removed the smoking material 33 or the predetermined time has elapsed (step 306), then steps 285, 286, 290, 295, and 200 are performed as necessary.

If the puff has ended (step 305), a puff counter is incremented (step 308), the collected flow samples (collected data) are processed, and several calculations are performed including puff duration, inter-puff interval, average puff flow rate, puff volume, peak puff flow rate, and time of peak puff flow rate to provide some puff information (step 310).

Figure 7:
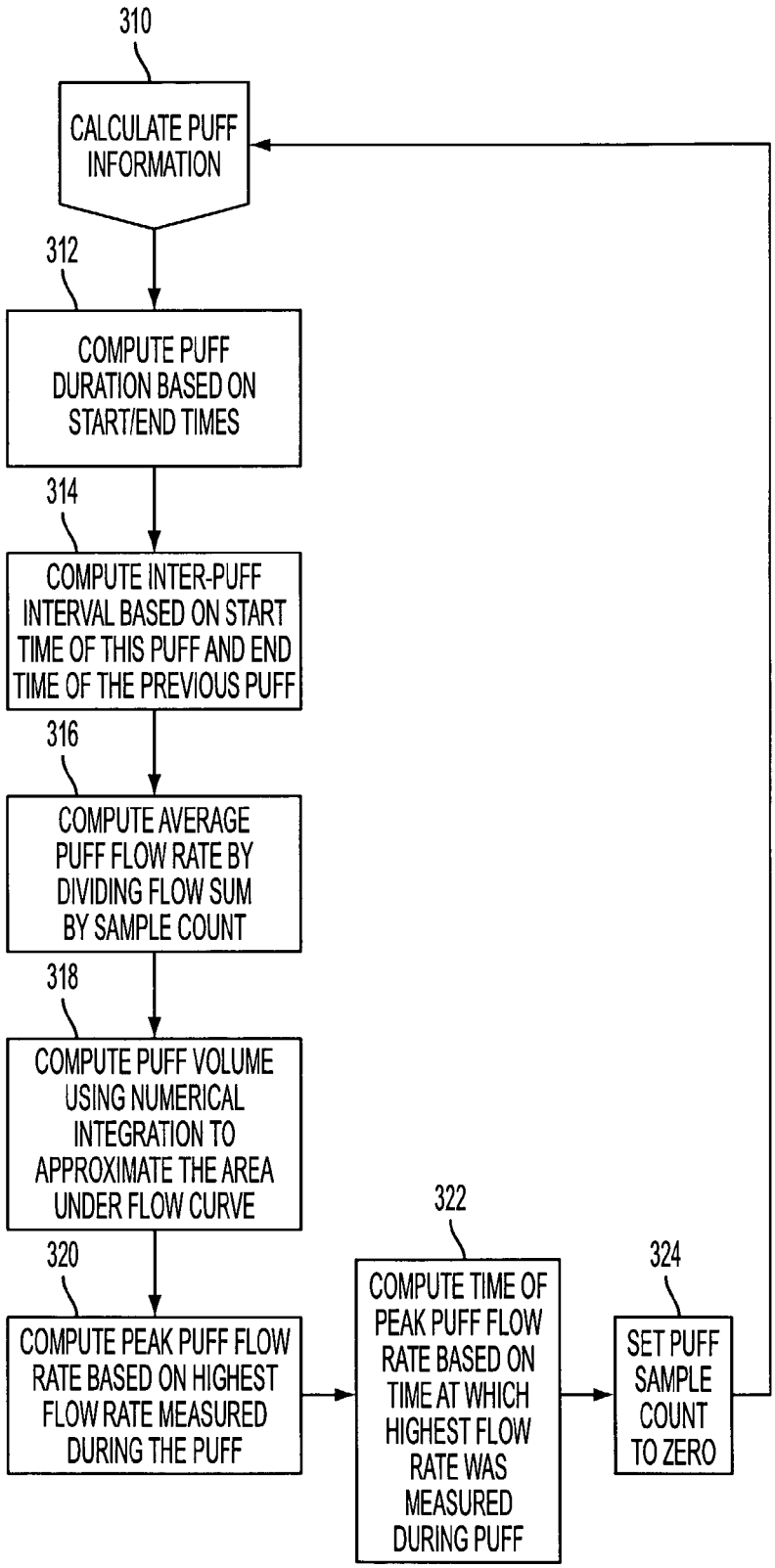

As shown in FIG. 7, the difference between the start time and the end time of the puff is calculated to provide the puff duration (step 312). The duration of the inter-puff interval is the length of time between the start time of the just measured puff and the end time of the immediately preceding puff (step 314). The average puff flow rate is computed by dividing sum of the measured flow rate samples by the number of samples taken during the puff duration (sample count) (step 316). A flow rate sample is measured by taking a sample (voltage), representing the instantaneous pressure differential in the smoking material holder 40. As discussed above, the flow rate sample is directly proportional to the square root of the pressure differential created by the flow within the smoking material holder 40. The general equation is $Y=mX^{1/2}$ where Y is the flow rate term. The constant m is an empirically-derived constant based on the respective diameters of the flow meter components, the location of the pressure taps, and the discharge coefficient of the flow meter. The term X represents the differential pressure, which is the analog voltage emitted by the pressure sensor 45.

The puff volume is calculated by approximating the area under the flow curve using numerical integration (step 318). Preferably, to minimize error, the numerical integration method utilizes the trapezoidal rule to approximate the area under the flow curve. Alternatively, the numerical integration method may utilize Romberg Integration, Simpson's ⅓ Rule, and Simpson's ⅜ Rule. The puff flow rates sampled during a puff are compared to each other to determine the puff peak flow rate (step 320). The time associated with the puff peak flow rate is also ascertained (step 322). After the puff information is calculated, the puff sample count is set to zero (324).

Figure 8:
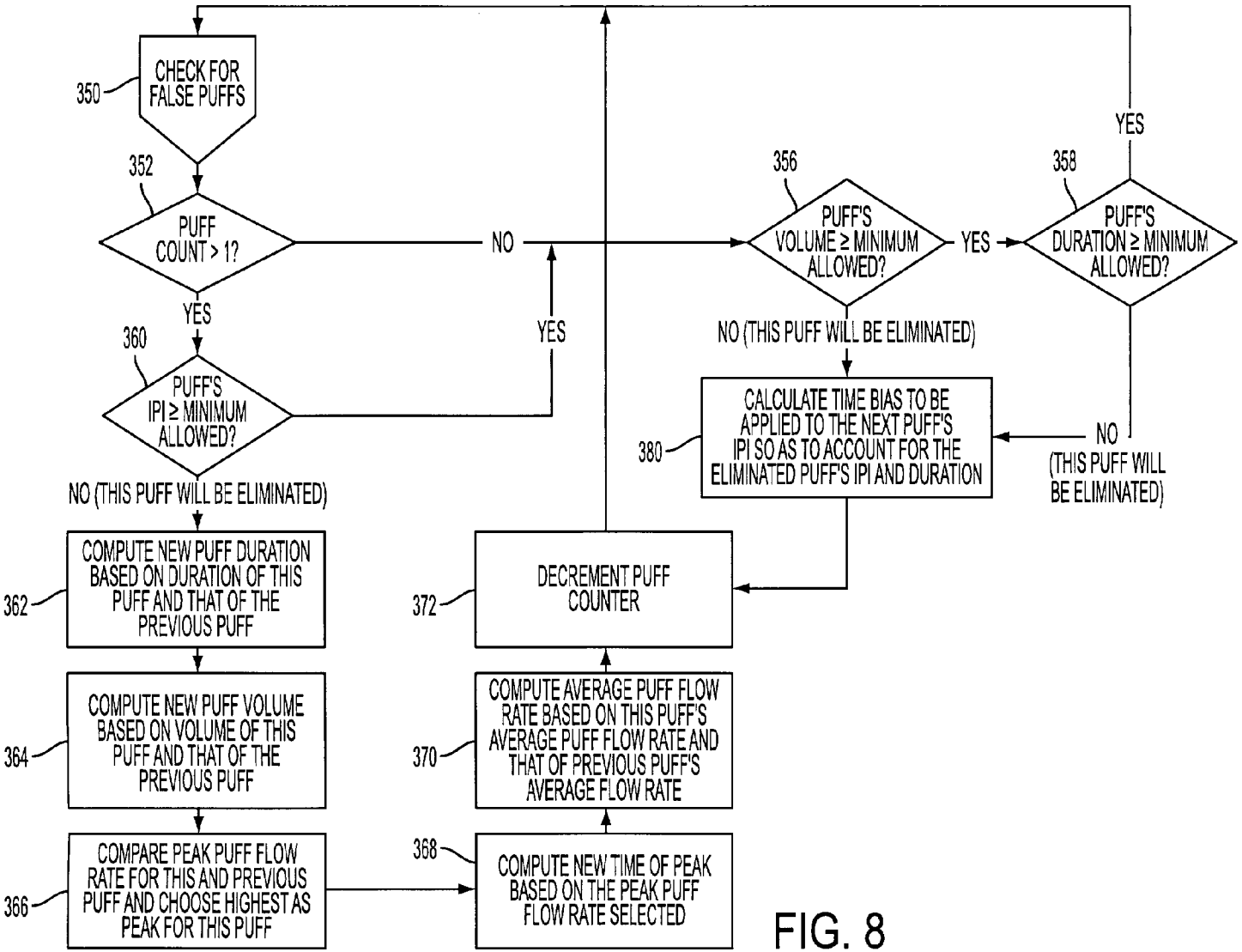

Once the puff information has been calculated, puff information is examined to determine whether a false puff has been detected (350). If a false puff is detected, it is eliminated (step 350, FIG. 8). False puffs are generally small puffs caused by a variety of environmental factors including noise, ashing of the smoking material, subject speaking, etc. False puffs are not representative of the subject's true smoking behavior and are preferably eliminated from the data in real time. As shown in FIG. 8, if the puff count kept by a puff counter (step 308) is zero or one (step 352), the puff's volume is greater than or equal to the predetermined minimum allowed (step 356), and the puff's duration is greater than or equal to the predetermined minimum puff duration allowed (step 358), then the puff is accepted as a measurement.

If the puff count is greater than one (step 352), the puff's inter-puff interval (IPI) is greater than or equal to the predetermined minimum allowed (step 360), the puffs volume is greater than or equal to the predetermined minimum allowed (step 356), and the puff's duration is greater than or equal to the predetermined minimum puff duration allowed (step 358), then the puff is accepted as a measurement.

If the puff count is greater than one (step 352) and the puff's IPI is less than the predetermined minimum (step 360), then a false puff has been detected, and this false puff must be eliminated, so that the portable smoking topography measuring unit 30 stores the proper smoking topographical information (smoking topographical data). If the puff's IPI is less than the predetermined minimum (step 360), a new puff duration is calculated based on the duration of this false puff, and the duration of the immediately preceding puff (step 362). A new puff volume is calculated based on the volume of the false puff and the immediately preceding puff (step 364). A new peak puff flow rate is calculated based on a comparison of the peak puff flow rate of the false puff and the peak puff flow rate of the immediately preceding puff. The higher of the two peak puff flow rates becomes the peak puff flow rate (step 366). The new time of the peak puff flow rate is determined based on the peak puff flow rate selected in step 366 (step 368). A new average puff flow rate is calculated based on the false puff's average puff flow rate and the immediately preceding puff's average puff flow rate (step 370). In order to calculate this new average puff flow rate, one or both of the false puff average flow rate and immediately preceding puff average flow rate may need to be weighted. Since the puff counter was incremented due to the false puff, the puff counter must be decremented (step 372). This completes the elimination of the false puff (step 350).

Returning to steps 352 and 360, if the puff count is not greater than one (step 352) or the puff's IPI is greater than or equal to the predetermined minimum allowed (step 360), then the system checks whether the calculated puff volume is less than a predetermined minimum volume (step 356). If the puff volume is less than the predetermined minimum volume (step 356), then the puff is a false puff. The system calculates a time bias to be applied to the next puff's IPI so as to account for the eliminated puffs IPI and duration (step 380), and the system decrements the puff counter (372). Also, if the puff's duration is less than the predetermined minimum duration (step 358), then the puff is a false puff. The system calculates a time bias to be applied to the next puff's IPI so as to account for the eliminated puffs IPI and duration (step 380), and the system decrements the puff counter (372). The positions of steps 356 and 358 may be switched in the flow chart in FIG. 8. This completes the elimination of the false puff (step 350).

Figure 5:
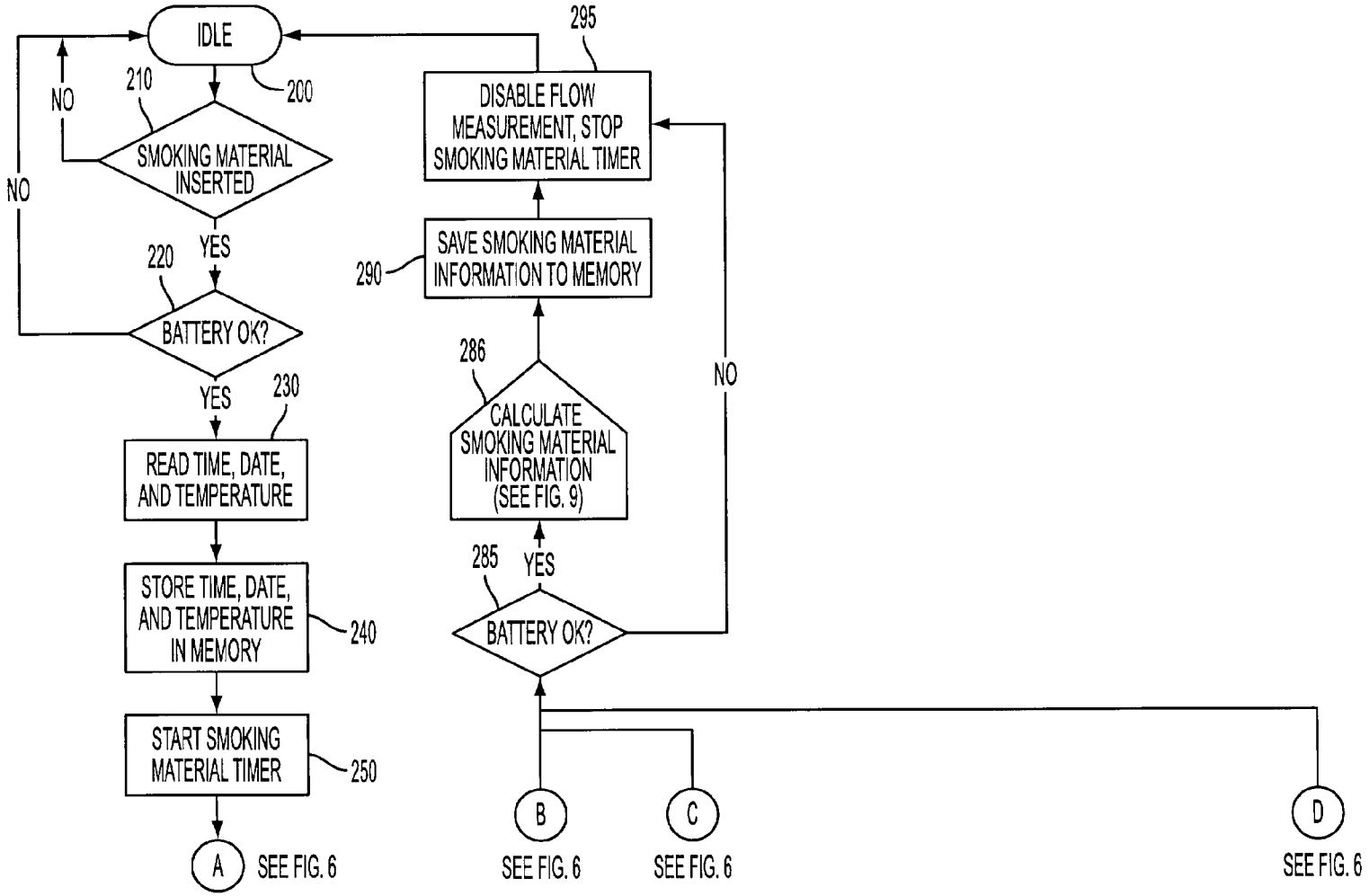
FIGS. 5–9 are flowcharts showing one embodiment of the present invention.
Figure 6:
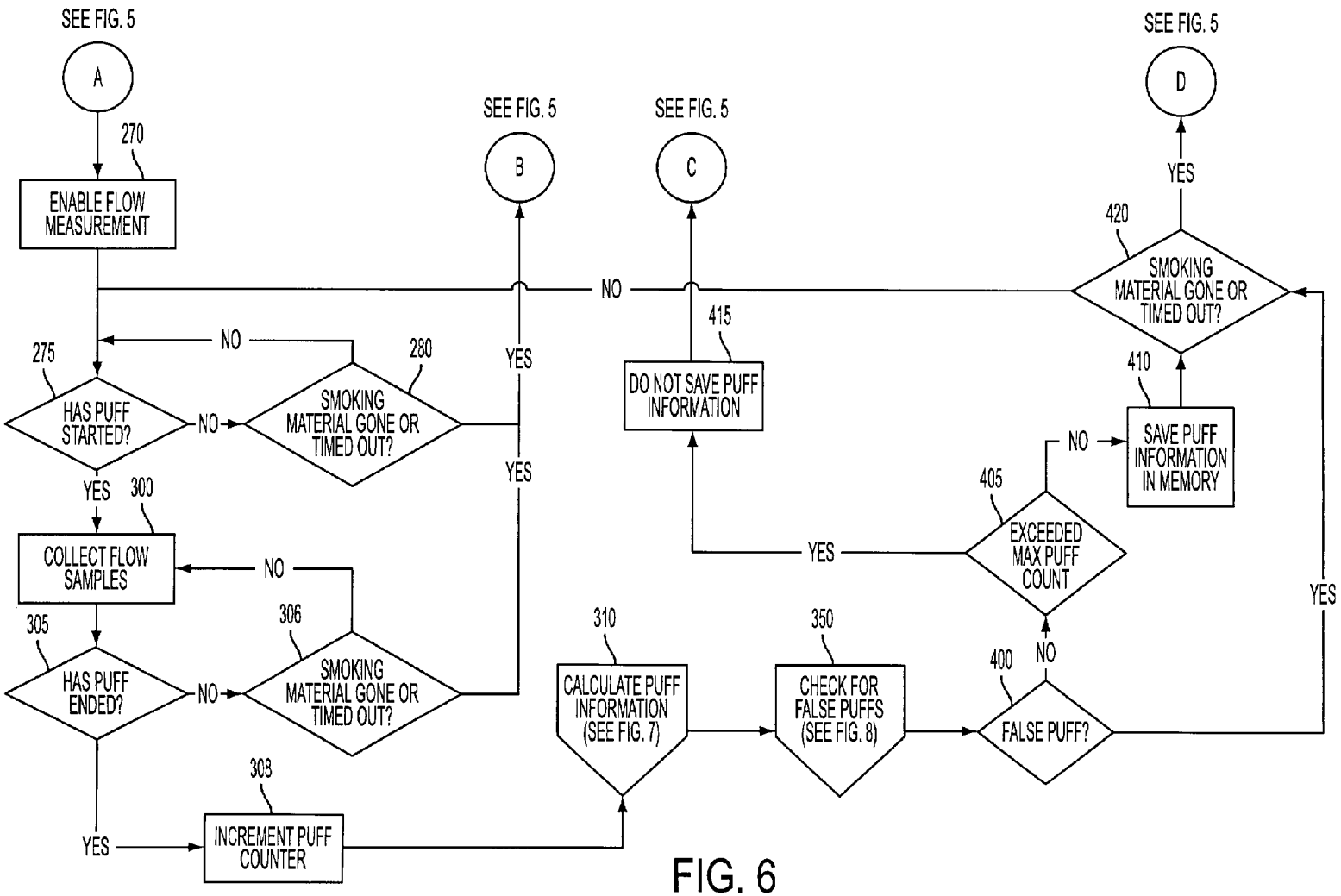

Referring to FIGS. 5–6, if a puff was accepted as a true puff (step 400) and the puff count has not exceeded a predetermined maximum puff count (405), then the puff information is saved in memory (410). If a puff was accepted as a true puff (step 400) and the puff count has exceeded a predetermined maximum puff count (405), then the puff information is not stored in memory (415). If a puff was found to be false (step 400), then the portable topography measurement unit 30 determines whether the smoking material 33 is still in the smoking material holder 40 and whether a predetermined time has been exceeded (step 420). If the smoking material 33 has been removed from the smoking material holder 40 or a predetermined amount of time has been exceeded (step 420), then the portable topography measurement unit 30 performs steps 285, 286, 290, 295, and 200 as necessary. If the smoking material 33 has not been removed from the smoking material holder 40 and a predetermined time has not been exceeded (step 420), then flow measurements to measure (collect) sample data continues (steps 275–420).

Figure 9:
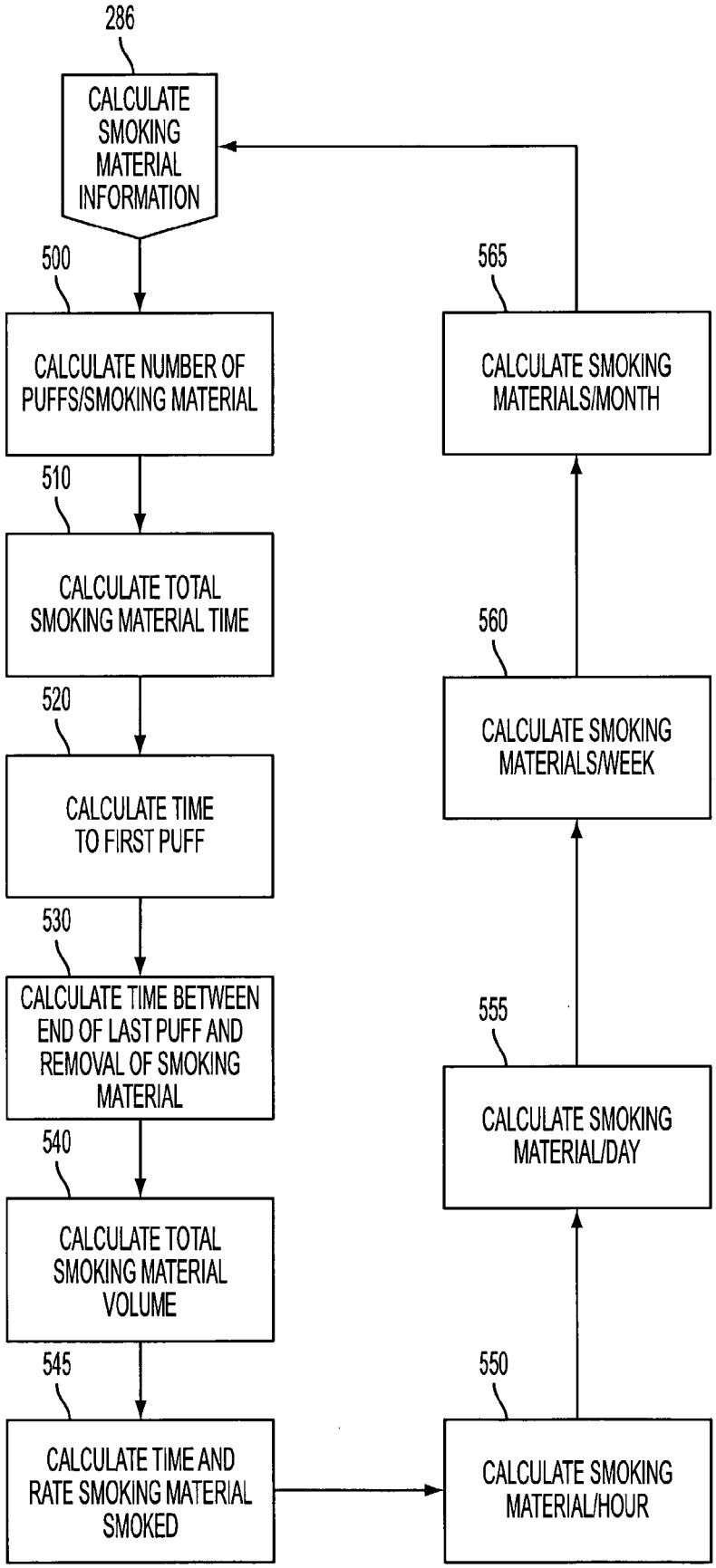

FIG. 9 is a flow chart showing the calculation of smoking material information of step 286. The following smoking material information is derived from smoking material measurements: puffs/smoking material (step 500); total smoking material time (step 510); time to first puff (step 520); time from the end of the last puff to removal of smoking material (step 530); total smoking material volume (step 540); smoking materials/hour (step 550); smoking materials/day (step 555); smoking materials/week (step 560); and smoking materials/month (step 565).

Figure 10:
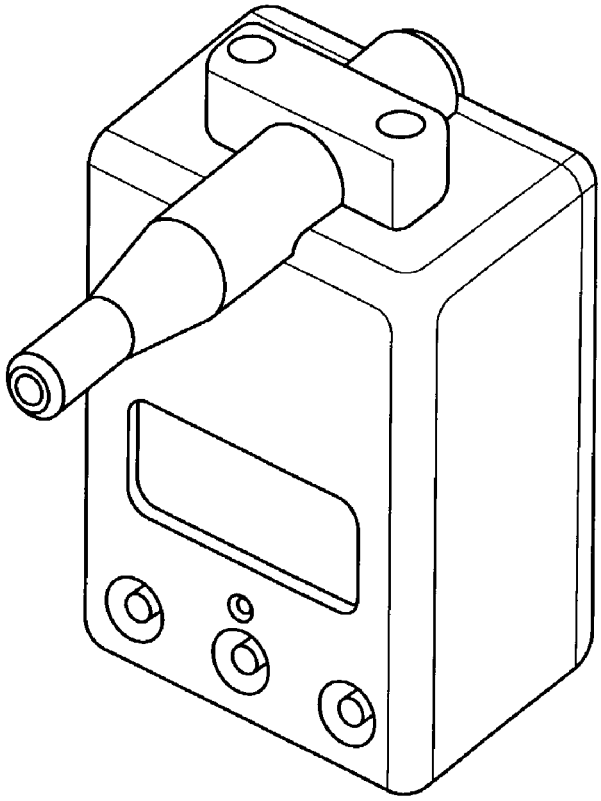
FIG. 10 is a depiction of a portable topography measurement device of the present invention.
Figure 11:
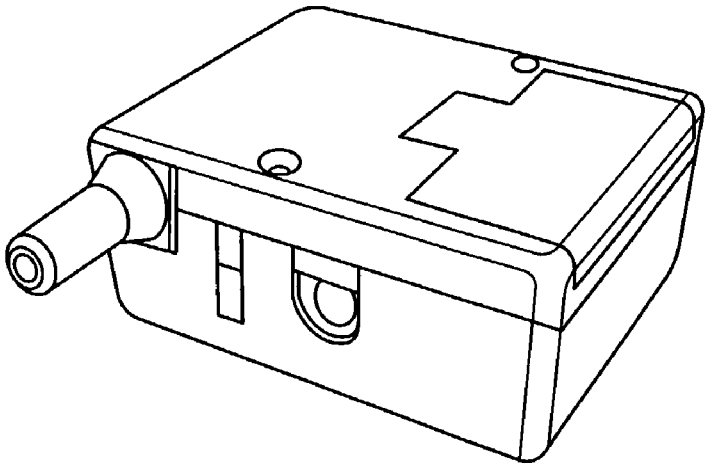
FIG. 11 is a depiction of another portable smoking topography measurement device of the present invention.

FIGS. 10–11 are depictions of the portable topography measurement devices.

As discussed above with reference to FIG. 2 and 3, the portable smoking topography measurement unit 30 collects the smoking topography data and performs calculations to provide smoking topography information. A user preferably places the portable smoking topography measurement unit 30 in the docking station 20. The workstation 100 and portable smoking topography workstation 30 perform a hand shaking process by way of the docking station 20, which includes an authentication process. If the portable smoking measurement unit 30 is authenticated, then the smoking topography information is downloaded into a memory of the workstation 100. Alternatively, the portable topography measurement unit 30 may perform only some of the calculations discussed above, and download both smoking topography data and smoking topography information to the workstation 100. Subsequently, workstation 100 may perform calculations using the smoking topography data to provide additional smoking topography information. For example, generating charts, graphs, and/or diagrams showing measures over time and/or aggregated measures for the purposes of higher level analysis. After the smoking topography information has been downloaded or calculated, the smoking topography may be displayed on a display 130.

Figure 12:
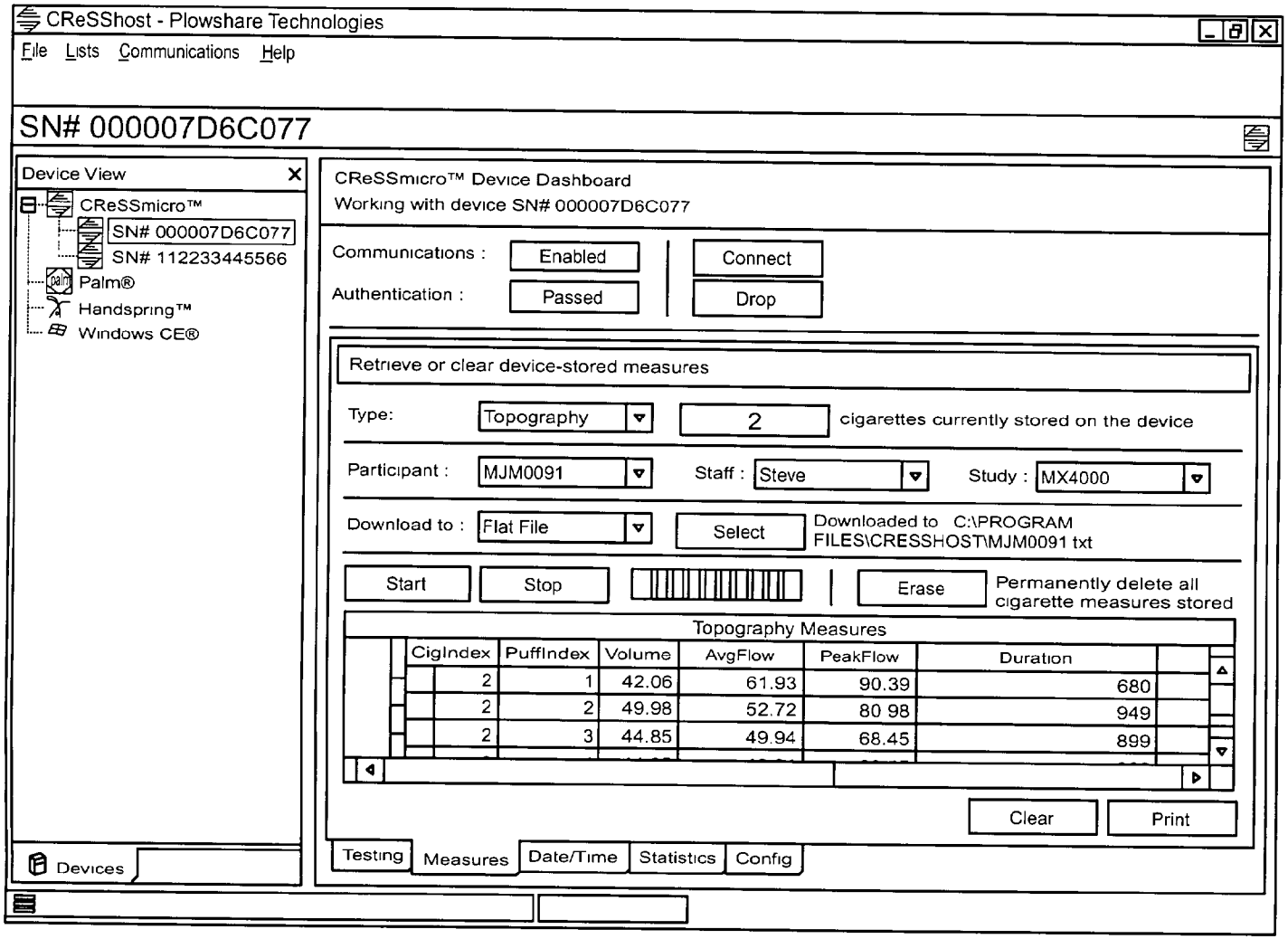
FIG. 12 is an example of a display of smoking topography information.

FIG. 12 provides an example of the display of smoking topography information.

Although the invention has been described for use with the Internet, web servers, and web pages, other types of networks, networking devices, and networked displayable information can be used with the invention, as will be appreciated by those skilled in the art. The embodiments and examples discussed herein are non-limiting examples.

While various embodiments of the present invention have been described above, it should be understood that they have been presented by way of example only, and not limitation. Thus, the breadth and scope of the present invention should not be limited by any of the above-described exemplary embodiments, but should instead be defined only in accordance with the following claims and their equivalents.

What is claimed as new and desired to be protected by Letters Patent of the United States is:

1. A method for providing smoking topographical information, comprising:

providing a portable smoking topography measurement unit having a smoking material holder, the portable smoking topography measurement unit being dockable with a docking station, while undocked from the docking station, the portable smoking topography measurement unit being adapted to perform the steps of:

receiving a smoking material by the smoking material holder of the portable smoking topography measurement unit;

detecting a puff of the smoking material; and measuring flow rate of smoke from the smoking material into a subject during said puff;

computing puff information at least the detected puff at least one of prior to and/or after docking;

computing smoking material information, wherein said computing smoking material information comprises at least one of:

detecting the receipt of the smoking material into the smoking material holder;

reading time of receipt of the smoking material from the real time clock to provide smoking material receipt time;

incrementing a puff counter each time a puff is detected;

detecting removal of the smoking material from the smoking material holder; and/or reading time of removal from the real time clock to provide smoking material removal time wherein said computing smoking material information further comprises reading the value of the puff counter after the smoking material is removed to provide the number of puffs per smoking material, and calculating time to first puff by determining the difference between smoking material receipt time and puff start time of first puff of the smoking material, and displaying at least one of the puff information and/or the smoking material information on a display.

2. The method of claim 1, wherein said detecting a puff comprises at least one of:

sensing said puff;

reading time said puff is sensed from a real time clock to provide a puff start time;

storing said puff start time;

detecting end of said puff;

reading time said puff ended from the real time clock to provide puff end time; and/or storing said puff end time.

3. The method of claim 2, wherein said computing puff information comprises computing puff duration for said puff based on difference between puff start time and puff end time.

4. The method of claim 2, wherein said computing puff information comprises computing an inter-puff interval based on difference between puff start time of one puff and puff end time of immediately preceding puff.

5. The method of claim 2, further comprising, while docked to the docking station, transferring the puff information to a workstation.

6. The method of claim 5, further comprising displaying the puff information on a display unit.

7. The method of claim 1, wherein said measuring flow rate of smoke comprises at least one of:

sampling the flow rate of smoke; and/or incrementing a sample counter each time the portable smoking topography measurement unit samples the flow of smoke to provide a puff sample count.

8. The method of claim 7, wherein said computing puff information comprises computing average flow rate for each puff by dividing the sum of the flow rates by the puff sample count.

9. The method of claim 7, wherein said computing puff information comprises computing puff volume.

10. The method of claim 7, wherein said computing puff information comprises computing a peak flow rate for said puff based on highest flow rate sampled during said puff.

11. The method of claim 10, wherein said computing puff information further comprises:

reading time when a flow rate sample is taken from a real time clock.

12. The method of claim 11, wherein said computing puff information comprises computing time of peak flow rate for said puff.

13. The method of claim 1, wherein said computing smoking material information further comprises calculating the total smoking material time by determining the difference between the smoking material receipt time and the smoking material removal time.

14. The method of claim 1, wherein said computing smoking material information further comprises calculating time interval from last puff to smoking material removal by determining the difference between smoking material removal time and end time of last puff of smoking material.

15. The method of claim 1, further comprising, while docked to the docking station, transferring the smoking material information to a workstation.

16. The method of claim 15, further comprising transferring puff information to said workstation.

17. The method of claim 1, wherein docking to a docking station comprises communicating with a workstation via at least one of wired or wireless communication.

18. A method for providing smoking assessment or treatment of smoking behavior based on smoking topographical information, comprising:

providing a portable smoking topography measurement unit having a smoking material holder adapted to receive a smoking material, the portable smoking topography measurement unit being dockable with a docking station, while undocked from the docking station, the portable smoking topography measurement unit being adapted to perform the steps of:

detecting a puff of the smoking material;

computing puff information from at least the detected puff prior to or after docking;

communicating said puff information prior to or after docking;

providing output based on said puff information prior to or after docking;

computing smoking material information, wherein said computing smoking material information comprises at least one of:

detecting the receipt of the smoking material into the smoking material holder;

reading time of receipt of the smoking material from the real time clock to provide smoking material receipt time;

incrementing a puff counter each time a puff is detected;

detecting removal of the smoking material from the smoking material holder; and/or reading time of removal from the real time clock to provide smoking material removal time;

wherein said computing smoking material information further comprises reading the value of the puff counter after the smoking material is removed to provide the number of puffs per smoking material, and calculating time to first puff by determining the difference between smoking material receipt time and puff start time of first puff of the smoking material; and displaying at least one of the puff information and/or the smoking material information on a display.

19. The method of claim 18, further comprising:

gathering smoking topographical information over time; and presenting said smoking topographical information in said output for at least one of monitoring, changing, assessing and/or treatment of smoking behavior.

20. The method of claim 18, further comprising:

measuring smoking topographical information in real-time to generate said output for at least one of smoking assessment and/or treatment of smoking behavior.

21. The method of claim 18, further comprising:

presenting smoking topographical information for at least one of smoking assessment and/or treatment of smoking behavior.

22. The method of claim 18, further comprising:

sending smoking topographical information to a workstation device while docked for at least one of storage, presentation, and/or at least one of smoking assessment and/or treatment of smoking behavior.

23. The method of claim 18, further comprising:

storing smoking topographical information to a workstation device for at least one of storage, presentation, and/or at least one of smoking assessment and/or treatment of smoking behavior.

24. The method of claim 18, further comprising:

providing smoking topographical information to at least one of a clinician and/or a staffmember for managing at least one of a participant and/or a smoker seeking at least one of assessment and/or treatment of smoking behavior.

25. The method of claim 18, further comprising:

measuring data relating to an inhaled substance.

26. The method of claim 25, wherein said measured data assesses dependence on said inhaled substance.

27. The method of claim 26, wherein said inhaled substance is present in smoke inhaled from at least one of tobacco, marijuana, and/or drugs.

28. The method of claim 18, wherein the communicating comprises:

communicating said puff information to a person desiring to at least one of assess and/or change smoking behavior.

29. The method of claim 18, wherein the providing output further comprises:

providing output for at least one of monitoring and/or treatment of smoking behavior based on said puff information.

30. The method of claim 18, wherein said treatment comprises at least one of reduction and/or cessation of smoking.

* * * * *